US005097571A

United States Patent [19]

Föhl

[11] Patent Number: 5,097,571

[45] Date of Patent: Mar. 24, 1992

[54] BUCKLE FOR A SAFETY BELT SYSTEM PROVIDED WITH A BELT PRETENSIONER

[75] Inventor: Artur Föhl, Schorndorf, Fed. Rep. of Germany

[73] Assignee: TRW Repa GmbH, Alfdorf, Fed. Rep. of Germany

[21] Appl. No.: 638,550

[22] Filed: Jan. 8, 1991

[30] Foreign Application Priority Data

Mar. 22, 1990 [DE] Fed. Rep. of Germany ..... 4009272

[51] Int. Cl.[5] ..... A44B 11/26

[52] U.S. Cl. ..... 24/641; 24/633

[58] Field of Search ..... 297/468; 24/633, 636-642, 24/645

[56] References Cited

U.S. PATENT DOCUMENTS 4,972,559 11/1990 Haglund ..... 24/637
5,008,989 4/1991 Wedler et al. ..... 24/633 X

FOREIGN PATENT DOCUMENTS 212507 3/1987 European Pat. Off. .
3533684 2/1987 Fed. Rep. of Germany .
WO87/00736 2/1987 PCT Int'l Appl. ..... 24/641

*Primary Examiner*—James R. Brittain
*Attorney, Agent, or Firm*—Tarolli, Sundheim & Covell

[57] ABSTRACT

A buckle for a safety belt system provided with a belt pretensioner is secured by a blocking pawl against unintentional opening at the end of the pretensioning stroke. By the locking pawl the release button is arrested at the housing before it has reached the end of its lost motion path. The driving of the locking pawl is by the inertia forces acting with a certain leverage at the center of gravity thereof at the end of the pretensioning stroke.

6 Claims, 5 Drawing Sheets

BUCKLE FOR A SAFETY BELT SYSTEM PROVIDED WITH A BELT PRETENSIONER

The invention relates to a buckle for a safety belt system provided with a belt pretensioner which is effective between the buckle and an anchoring point on the vehicle bodywork or on a vehicle seat.

Buckles for safety belt systems are known in numerous constructions. A design has proved itself in which in the housing of the buckle a guide path is formed for the insert tongue and a locking bar pivotally mounted or displaceably guided on the housing transversely of the guide path cooperates with a detent opening of the insert tongue. A blocking member guided displaceably parallel to the guide path in the housing holds the locking bar in its locking position as long as a release key likewise guided displaceably parallel to the guide path in the housing is in its rest position. The release key is coupled to the blocking member to move the latter on actuation into a release position in which the locking bar comes free of the detent opening of the insert tongue.

The use of such a buckle in safety belt systems comprising a belt pretensioner involves no problems if the pretensioning force for example acts at the belt retractor. Belt pretensioners have also already been proposed which are effective between the buckle and its securing point to the vehicle bodywork or the vehicle seat. Such belt pretensioners shorten the distance between the securing point of the buckle and the buckle itself by a few centimeters, for example 10 cm. The belt pretensioners used in such cases are mechanically constructed and include a force accumulator in the form of a tensioned spring which is released by a sensor responsive to inertia forces and effects a belt pretensioning when required.

To make available the necessary pretensioning force, mechanical pretensioning means require a very heavy spring. The vehicle-sensitive release of such a spring with readily reproducible release thresholds presents great difficulties.

With a pyrotechnical belt pretensioner driven by a piston/cylinder linear drive with a pyrotechnical gas generator acting with pressurized gas on the piston in the cylinder in the event of release, high pretensioning forces can be obtained relatively easily. It has however now been found that a buckle of the type described above when used in conjunction with such a pyrotechnical belt pretensioner tends to open accidentally.

The invention provides a buckle which can be used without any problems in safety belt systems equipped with belt pretensioners which generate relatively high pretensioning accelerations. The buckle of the invention, with regard to its design, size and construction, corresponds to lock constructions not specifically intended for this purpose.

This is achieved by a buckle wherein the release key or button is arrestable by means of a locking pawl at the housing against movement in the actuating direction, the locking pawl being biased into a position in which it does not obstruct the actuating travel of the release button. The locking pawl is pivotally mounted on the housing or on the release button. The center of gravity of the locking pawl is offset with respect to the pivot axis of the pawl perpendicularly to the movement direction of the buckle in the pretensioning movement by such an amount that the locking pawl under the action of a deceleration of the buckle exceeding a predetermined threshold value is moved in its movement direction, overcoming the biasing means, into its engagement position in which it arrests the release button on the housing. In normal use the locking pawl is held by the biasing means in its rest position so that the release button can be actuated without obstruction. In a tightening, or pretensioning, operation the buckle is moved with high acceleration towards its anchoring point. At the end of this pretensioning stroke the pretensioning movement is abruptly terminated so that high decelerations occur on the buckle and the functional parts contained therein. The release button now tends to execute a release travel under the action of its mass inertia. It firstly performs a lost motion travel which is provided in all common lock constructions to prevent unintentional opening of the buckle. Before the release button has reached the end of its lost motion travel the locking pawl has been pivoted under the action of the same deceleration into its engagement position so that it prevents a further movement of the release button in the actuating direction thereof. It has been found that such a locking pawl can be associated with existing buckle constructions without having to modify the design, size and construction. It is therefore easily possible to integrate it subsequently into existing constructions to make proven buckle constructions suitable for the use in restraining systems with belt pretensioners.

Further features and advantages of the invention will be apparent from the following description of several embodiments of the invention and from the drawings, to which reference is made. In the drawings.

Figure 1:
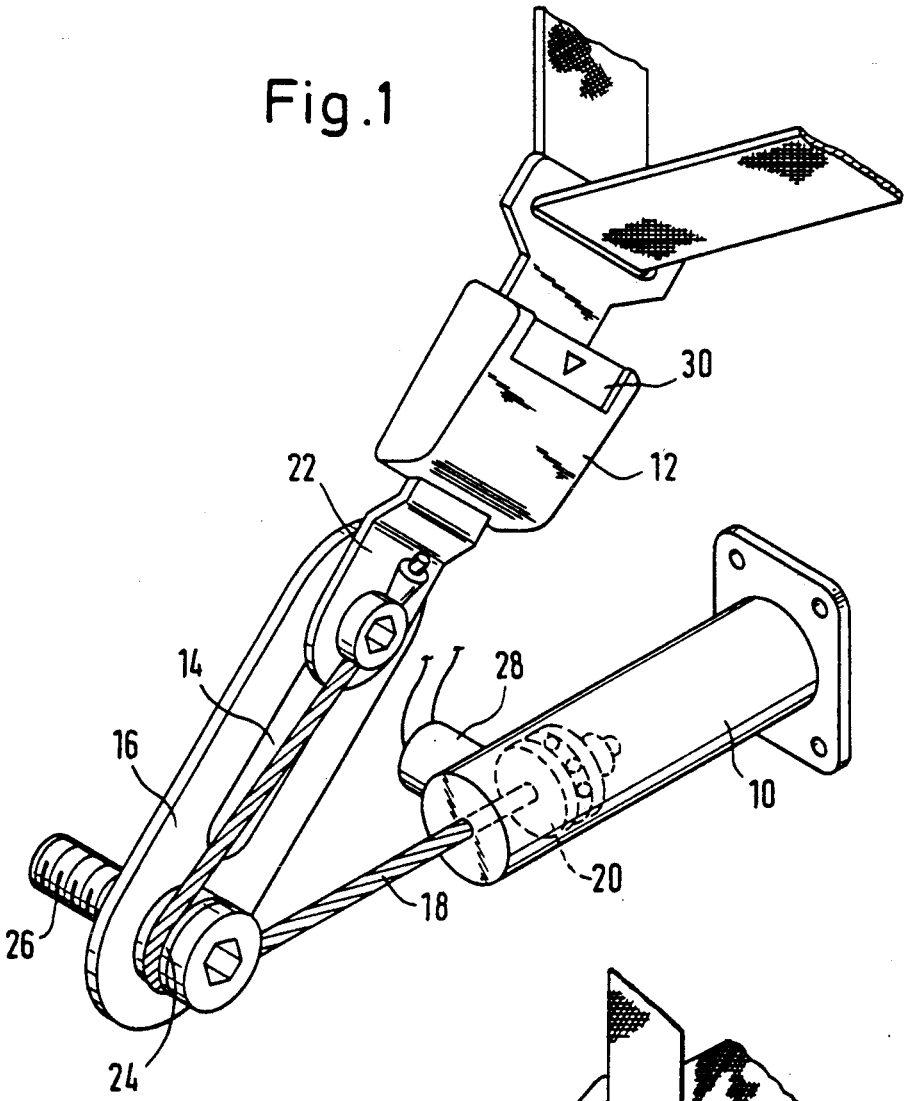
FIG. 1 shows a schematic perspective view of a belt pretensioner engaging a buckle.

The belt pretensioner shown in FIG. 1 consists of a pyrotechnical piston/cylinder pretensioning drive 10 of which the cylinder is anchored to the vehicle bodywork, a longitudinal guide for the buckle 12 in the form of an elongated anchoring plate 16 provided with a slot 14, a pulling cable 18 connecting the piston 20 to the securing fitting 22 of the buckle and a deflection pulley 24 via which the pulling cable 18 is guided and which is mounted on a securing pin 26 by means of which the anchoring plate 16 is secured to the vehicle bodywork.

Figure 2:
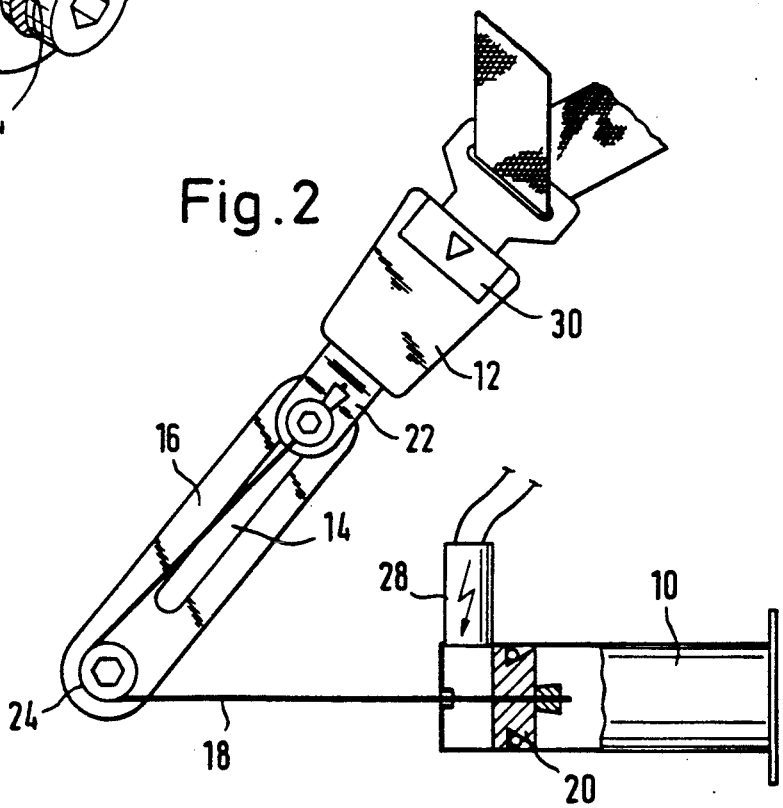
FIG. 2 is a partially sectioned side elevation of the pretensioner.

FIGS. 1 and 2 show the belt pretensioner in the non-activated state. As apparent from FIG. 2, an end face of the piston 20 can be subjected to pressurized gases which are generated by a pyrotechnical gas generator 28. Under the action of the pressurized gases the piston 20 is driven with extremely high acceleration and via the pulling cable 18 and the securing fitting 22 draws the buckle 12 downwardly. At the lower end of the slot 14 the movement of the buckle 12 is suddenly retarded. By a return blocking means integrated into the piston 20 the buckle 12 is prevented from being able to move in the direction of its starting position after an effected pretensioning.

When at the end of the pretensioning travel the buckle 12 is suddenly retarded, at the release button 30 and the parts connected thereto high inertia forces occur which are directed in the direction of the release movement of the release button. By the construction of the buckle described now with reference to FIGS. 3 to 10 these inertia forces are prevented from leading to an unintentional opening of the buckle.

The anchoring fitting 22 is connected by a rivet connection to the loadbearing part of the lock housing 32. Said housing 32 is surrounded by a cover in the form of a plastic dish 34. The lock housing 32 is provided with an upwardly drawn bearing bracket which is U-shaped in plan view and between the two parallel legs 36, 38 of which a pivot locking bar 40 is mounted by means of a bearing pin 42. The release button 30 comprises two parallel arms 30A, 30B which extend into the lock interior and which at their free end are provided with a guide slot through which the outer ends of the bearing pin 42 engage. The release button 30 is slidably guided at the outer sides of the legs 36, 38.

The lock housing 32 is provided with a guide path 44 for an insert tongue 46 which comprises a detent opening 48. A control cam 50 of the pivot locking bar 40 projects into the guide path 44. The pivot locking bar 40 is further provided with a detent nose 52 in the region of its free end.

Between the two arms 30A, 30B of the release button 30 a blocking member 54 in the form of a steel plate is mounted above a nose 56 at the free end of the pivot locking bar 40. A pressure spring 58 bears with its one end on the blocking member 54 and its other end on the lever arm 60 of the pivot locking bar 40 which lies opposite the control cam 50.

Figure 3:
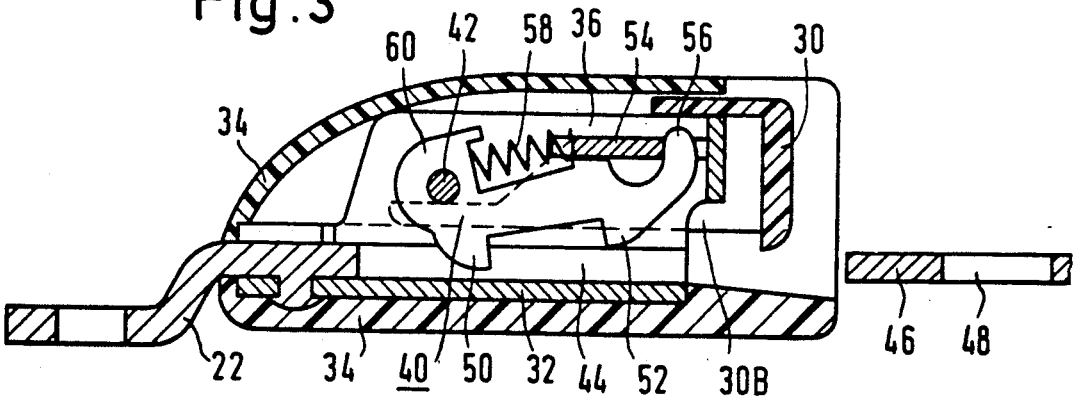
FIG. 3 is a longitudinal section of a buckle according to the invention in the state in which the release button is actuated.

In the position shown in FIG. 3 the nose 56 of the pivot locking bar 40 engages behind the front edge of the blocking member 54 so that the detent nose 52 is pivoted out of the guide path 44 by the pressure spring 58. The release button 30 is shown in its actuated position.

Figure 4:
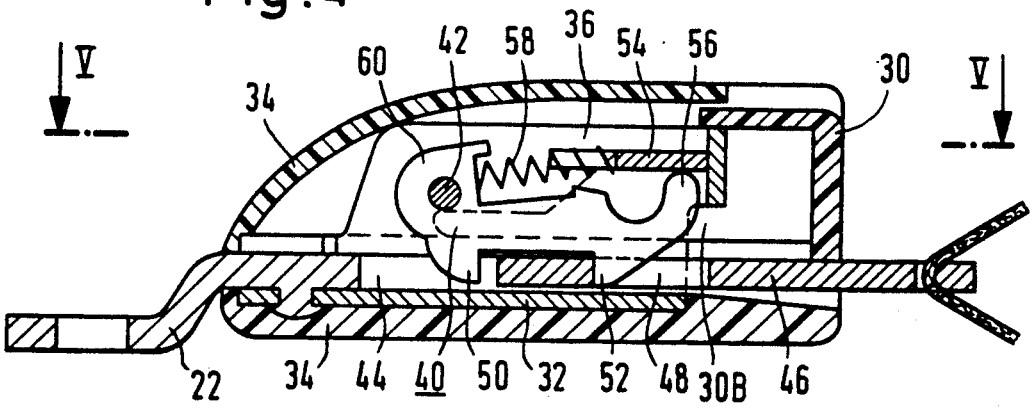
FIG. 4 is an analogous side elevation of the buckle in the state in which the insert tongue is inserted and locked.
Figure 5:
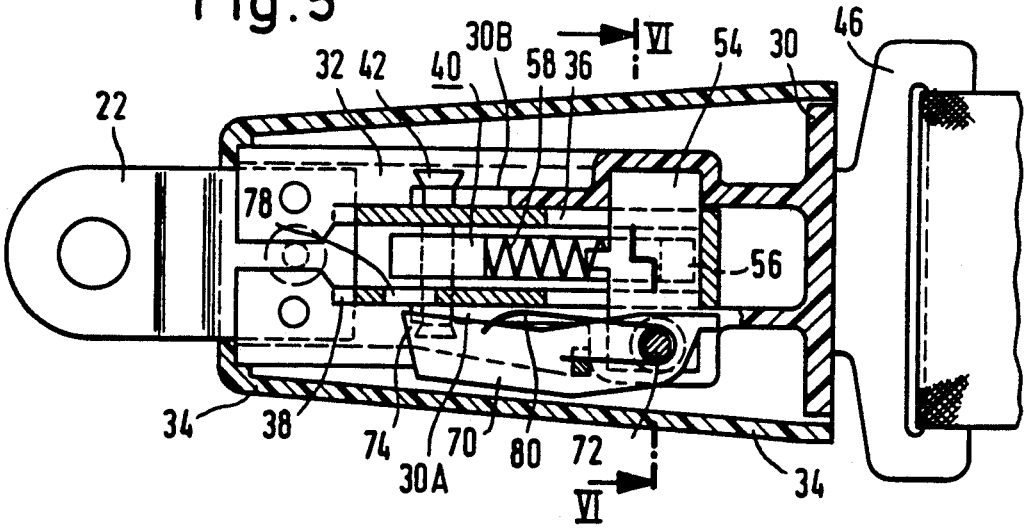
FIG. 5 is a sectional view of the buckle along the line V—V of FIG. 4.
Figure 6:
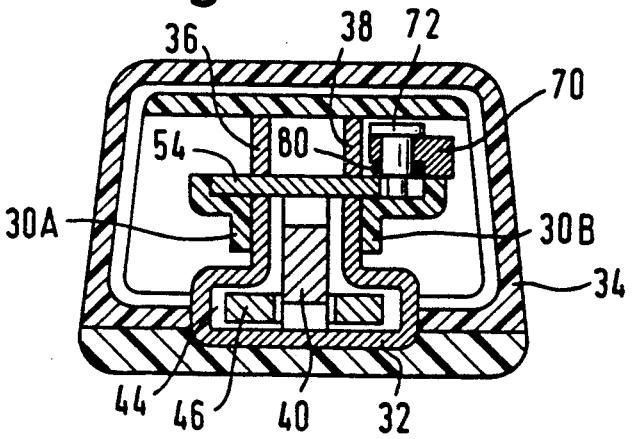
FIG. 6 is a cross-section of the buckle along the line VI—VI of FIG. 5.
Figure 7:
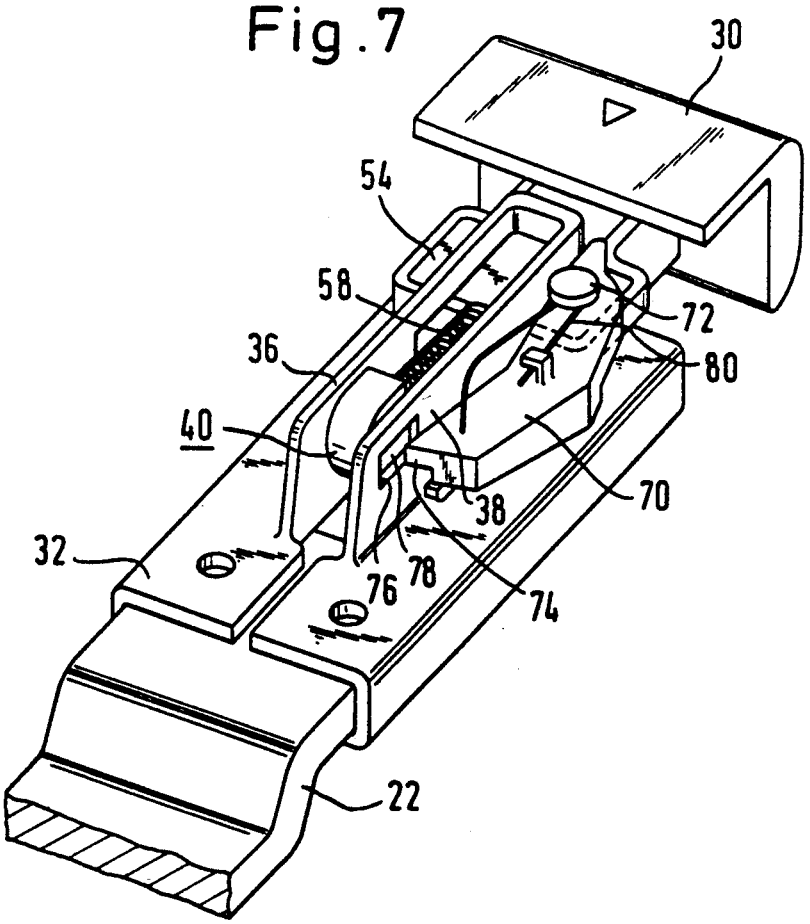
FIG. 7 is a schematic perspective view of the functional parts of the buckle.
Figure 8:
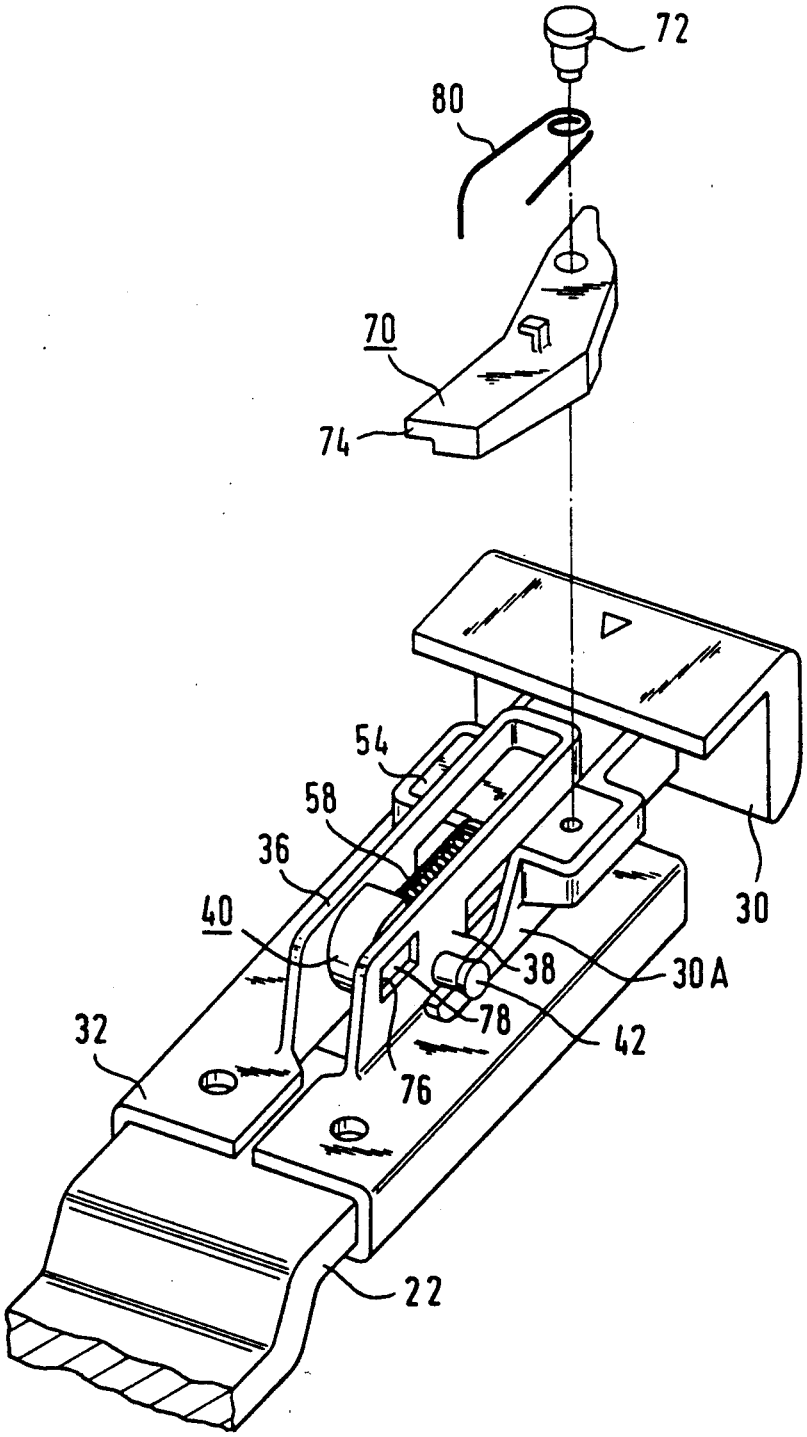
FIG. 8 is an exploded view of the functional parts of the buckle.

In the condition shown in FIG. 4 the insert tongue 46 is inserted and the detent nose 52 is engaged in the detent opening 48.

In the embodiment shown in FIGS. 5 to 9 a locking pawl 70 is pivotally mounted on the release button 30 on a bearing pin 72, the axis of which is aligned perpendicularly to the guide path 44. The locking pawl 70 is formed as one-armed lever, at the one free end of which the locking pawl is mounted and the other free end of which forms the pawl tip 74. Said pawl tip 74 cooperates with a detent edge 76 at a rectangular opening 78 in the leg 38. The locking pawl 70 is biased into its rest position out of engagement with the detent edge 76 by a spring 80 bent from spring wire. Since the locking pawl 70 is formed as narrow elongated lever extending parallel to the leg 38 and in the immediate vicinity of the latter, it can easily be accommodated within the plastic dish 34 without changing the form thereof, in particular without increasing the dimensions thereof.

Figure 9:
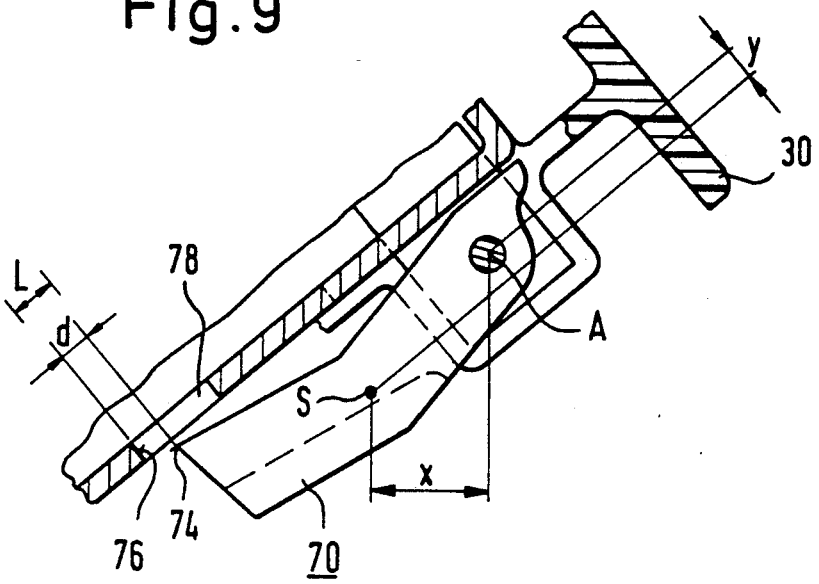
FIGS. 9 and 10 show enlarged detail views of two embodiments for explaining their mode of operation.

The mode of operation of the buckle will now be described with reference to FIG. 9. FIG. 9 shows the alignment of the buckle and the locking pawl in normal use: The longitudinal axis of the buckle, which coincides with its movement direction in the event of pretensioning, is inclined to the vertical by an angle of for example about 35°. Because of this arrangement, a gravity component acts on the locking pawl 70 and biases the latter into its normal rest position. This biasing into the rest position is further assisted by the spring 80 not shown in FIG. 9 for simplification. Other constructions are however also possible in which the biasing of the locking pawl 70 into its rest position is either by gravity alone or by spring bias alone.

If as in the embodiment of FIG. 9 no additional spring is employed, a gravity component G acts on the locking pawl 70 and engages with the leverage X on the center of gravity S of the locking pawl. On the other hand, the center of gravity S is offset with respect to the pivot axis, denoted by A, of the locking pawl 70 by an amount Y perpendicularly to the movement direction of the buckle in the event of pretensioning. Due to this offsetting the mass inertia forces engaging the center of gravity S on abrupt deceleration of the locking pawl 70 become effective with the leverage Y to pivot the locking pawl 70 into its engagement position at the blocking edge 76 of the opening 78. The engagement movement of the locking pawl 70 however does not occur until the biasing force holding it in its rest position has been overcome. The following relationship thus applies:

$$X \cdot G < m \cdot a \cdot y$$

wherein m is the mass of the locking pawl 70 with respect to the center of gravity S and a a predetermined threshold value of the deceleration above which the locking pawl 70 is pivoted into its engagement position.

As apparent from FIG. 9 the pawl tip 74 lies in its rest position at a distance d from the detent edge 76. Said distance d is large enough to ensure that the locking pawl 70 is certain to enter the opening 78 before it reaches the level of the detent edge 76. On the other hand, this distance d is appreciably smaller than the lost motion path L of the release button 30 likewise indicated in FIG. 9, thus ensuring that the release button 30 is arrested before the end of the lost motion path L is reached.

In the dimensioning of the amount y it should be ensured, taking account of the mass of the locking pawl 70, that the forces effecting the driving of the locking pawl into its engagement position are large enough to drive the locking pawl very rapidly into the opening 78. For the same reason the predetermined threshold value for the deceleration a above which the biasing force is overcome is made relatively small. A value of about −5 g is a suitable value for on the one hand offering only small resistance to the forces effecting the driving of the locking pawl 70 but on the other hand ensuring reliable remaining of the locking pawl in its rest position in the normal operating state. By the same criteria, the strength of the spring 80 can be calculated if said spring is to generate the bias alone or in cooperation with gravity.

Figure 10:
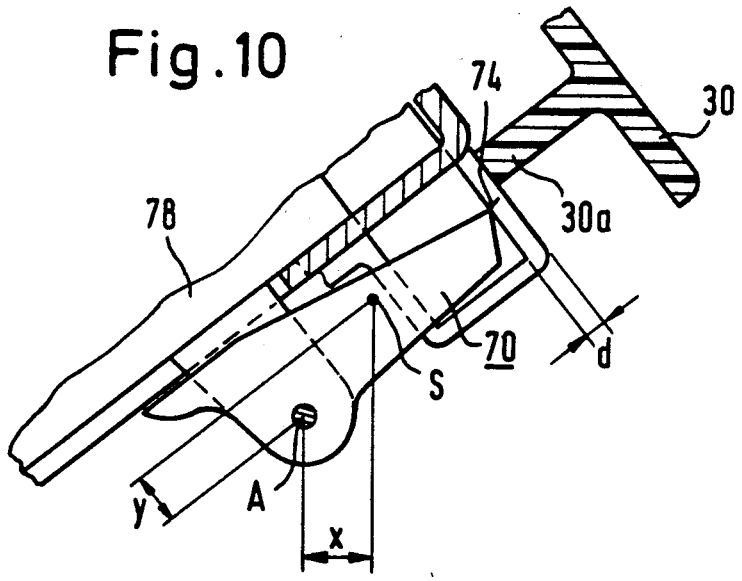

In the embodiment according to FIG. 10 the locking pawl 70 is pivotally mounted on the housing. With its pawl tip 74 it is movable into the path of movement of a rib 30*a* of the release button 30. The locking pawl 70 is held by the gravity component engaging its center of gravity S with the leverage X in its normal rest position in which it does not obstruct the release travel of the button 30. In the event of pretensioning, due to the high decelerations which then occur at the end of the pretensioning stroke an inertia force acts at the center of gravity S with the leverage y which effects a pivoting of the locking pawl 70 anticlockwise into the engagement position thereof. For the dimensioning of the distance d and the amounts y and X the same considerations apply as for the embodiment according to FIG. 9.

I claim:

1. A buckle for a safety belt system provided with a belt pretensioner which is effective between said buckle and an anchoring point on the vehicle bodywork or a vehicle seat by moving said buckle towards the anchoring point, said buckle comprising a housing, a guide path for an insert tongue in said housing, a locking bar mounted in said housing for cooperation with a detent opening of the insert tongue, a release button displaceably guided within said buckle, displacement of said release button being parallel to the guide path in said housing and releasing said locking bar from said detent opening on said insert tongue, said release button being movable from a rest position in an actuating direction across a lost motion path before releasing said locking bar, and a locking pawl cooperating with a detent edge on said housing for arresting movement of said release button in the actuating direction prior to release of said locking bar, said locking pawl being biased by biasing means into a position in which said locking pawl does not arrest movement of the release button in said actuating direction, said locking pawl being mounted on said release button, said detent edge on said housing being located at a distance from a pawl tip of said locking pawl along the movement direction of the buckle when the release button is not actuated, said locking pawl being pivotable about a pivot axis, the pivot axis being perpendicular to the movement direction of said buckle in a pretensioning movement, the center of gravity of said locking pawl being offset with respect to the pivot axis of said pawl by an amount such that said locking pawl, under the action of a deceleration of said buckle exceeding a predetermined threshold value, overcomes said biasing means and is moved into engagement with said detent edge to arrest said release button from further movement in said actuating direction.

2. Buckle according to claim 1, wherein said biasing means are formed at least partially by the gravity acting on said locking pawl.

3. Buckle according to claim 1, wherein said biasing means are formed at least partially by a spring.

4. Buckle according to claim 1, wherein said locking pawl forms a one-armed lever which extends generally parallel to the movement direction of the buckle.

5. Buckle according to claim 1, wherein said predetermined threshold value of the deceleration and said lost motion path of the release button are adapted to each other in such a manner that the locking pawl under the action of the deceleration occurring at the end of the pretensioning stroke is moved into its engagement position before the release button under the action of the same deceleration and due to its mass inertia has reached the end of its lost motion path.

6. Buckle according to claim 5, wherein said predetermined threshold value is about −5 g.

* * * * *